US005717987A

United States Patent [19]

Fromm

[11] Patent Number: 5,717,987

[45] Date of Patent: Feb. 10, 1998

[54] DEFLECTION LOADED METERING BLADE

[75] Inventor: Paul M. Fromm, Rochester, N.Y.

[73] Assignee: Xerox Corporation, Stamford, Conn.

[21] Appl. No.: 369,634

[22] Filed: Jan. 6, 1995

[51] Int. Cl.[6] ..... G03G 15/20

[52] U.S. Cl. ..... 399/325; 118/DIG. 1

[58] Field of Search ..... 355/284, 285, 355/282, 289, 290, 295; 399/324, 325; 118/60, DIG. 1

[56] References Cited

U.S. PATENT DOCUMENTS

| | | | |
|---|---|---|---|
| 3,996,886 | 12/1976 | Braun | 118/60 |
| 4,214,549 | 7/1980 | Moser | 118/60 |
| 4,352,551 | 10/1982 | Iwao | 355/284 |
| 4,541,707 | 9/1985 | Yoshinaga | 355/284 |
| 4,934,930 | 6/1990 | Soga | 432/60 |
| 5,046,146 | 9/1991 | Bartman et al. | 219/216 |
| 5,200,786 | 4/1993 | Fromm et al. | 355/284 |
| 5,212,529 | 5/1993 | Morris et al. | 355/290 |
| 5,374,983 | 12/1994 | Isogai | 355/284 |

*Primary Examiner*—William J. Royer

[57] ABSTRACT

A deflection loaded metering blade for contacting a metering roll in a RAM system. A thin metal (steel) leaf spring and holder the width of the fuser roll is used to support an elastomeric blade tip in contact with the metering roll surface. The relative mounting positions of the spring and metering roll result in an interference with each other thereby causing the spring to deflect and produce the required load. Thus, the loading and metering functions are separated, the former being accomplished by the spring and the latter being performed by the elastomer blade.

12 Claims, 4 Drawing Sheets

BEST AVAILABLE COPY

DEFLECTION LOADED METERING BLADE

BACKGROUND OF THE INVENTION

The present invention relates to fuser apparatus for electrostatographic printing machines and in particular to a release agent metering device forming a part of a Release Agent Management (RAM) system for use in a heat and pressure, roll fuser apparatus.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

One method of applying release agent material to a roll fuser comprises using a combination metering and donor roll arrangement wherein the release agent material or oil is metered on the metering roll using a metering blade structure. It is highly desirable that a constant loading force be applied between the metering blade and the metering roll at all times throughout the fusing process.

Typical metering blades of the prior art comprise a small rubber blade in a rigid holder, the latter of which is allowed to pivot and is spring loaded against the metering roll. Unless the pivot point of the blade holder coincides with metering roll tangent through the blade contact point, the load will change with commencement of metering roll rotation. At the extremes, the load can fall to zero or rise to infinity when the pivot point is near the radial line passing through the aforementioned contact point, depending on the side of the line the pivot in on and assuming a totally rigid set up.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

Various systems have been used to deliver release agent fluid to the fuser roll including the use of oil soaked rolls and wicks with and without supply sumps as well as oil impregnated webs. A another type of RAM system is disclosed in U.S. Pat. No. 4,214,549 granted to Rabin Moser on Jul. 29, 1980. As disclosed therein, release agent material is contained in a sump from which it is dispensed using a metering roll and a donor roll, the former of which contacts the release agent material and the latter of which contacts the surface of the heated fuser roll. A metering blade engaging the metering roll serves to smooth or meter the release agent material to a a predetermined thickness.

Xerox Disclosure Journal (XDJ) Volume 7, Number 3 dated May/June 1982 discloses a release agent management system for a roll fuser apparatus. The apparatus comprises a fuser roll to which silicone oil is applied in order to counteract toner offset to the fuser roll. The fuser roll cooperates with a softer pressure roll to fuse toner images to a copy substrate such as plain paper. The silicone oil which is contained in a sump is applied to the surface of the fuser roll by means of a rotating brush which is adapted to be rotated in the opposite direction to that of the fuser roll. The brush engages one end of a wick while the other end of the wick is immersed in the silicone oil. Thus, the brush picks up silicone oil from the wick and conveys it to the fuser roll surface. Since the brush rotates counter to the fuser roll the brush bristles strip the lead edge of the copy and deflect it down and away from the fuser roll. The brush fibers undergo a snapping or flicking action as they move out of the nip formed between them and the fuser roll. It is this action which yields the stripping action. The oil application rate is controlled by the brush fiber density and the velocity of the fuser roll.

BEST AVAILABLE COPY

BRIEF SUMMARY OF THE INVENTION

According to the present invention, there is provided a deflection loaded metering blade for contacting a metering roll in a RAM system. To this end, a thin metal (steel) leaf spring holder the width of the fuser roll is used to support the blade tip in contact with the metering roll surface. The relative mounting positions of the spring and metering roll result in an interference with each other thereby causing the spring to deflect and produce the required load between the blade tip and the metering roll surface. The spring holder which is mounted in a cantilevered manner is relatively rigid and not allowed to rotate or pivot.

Deflection loaded metering blades exhibit less load change than pivoting spring loaded blades for three reasons. First, the deflection loaded holder assembly is not allowed to rotate or pivot. Second, the flexible nature of the steel spring allows the blade tip to move circumferentially with the metering roll as it rotates without significant change in load. Circumferential motion is possible due to a slight curvature increase of the deflected spring/blade. In the rigid case, any circumferential motion of the tip causes rotation of the holder and increases interference and thus load change. Third, due to the design of the deflection loaded metering blade, the axis of the spring can easily be aligned closer to the tangent line than a radial line through the point of contact of the blade with the roll surface.

The most significant aspect of the deflection loaded metering blade is the separation of the metering function from the loading function and the large tolerance of dimensional changes that it provides. Thus, a thin metal (steel) spring provides load to a rubber edge that meters oil off the metering roll. The rubber edge may or may not be a sheet of rubber on top of the spring which is deflected. Deflection loaded blades assemblies of the type herein contemplated can be made very compact. The spring holder can be positioned above or below the point of blade contact with the metering roll.

For a better understanding of the present invention, reference may be had to the accompanying drawings wherein the same reference numerals have been applied to like parts and wherein:

DESCRIPTION OF THE PREFERRED EMBODIMENT

Figure 3:
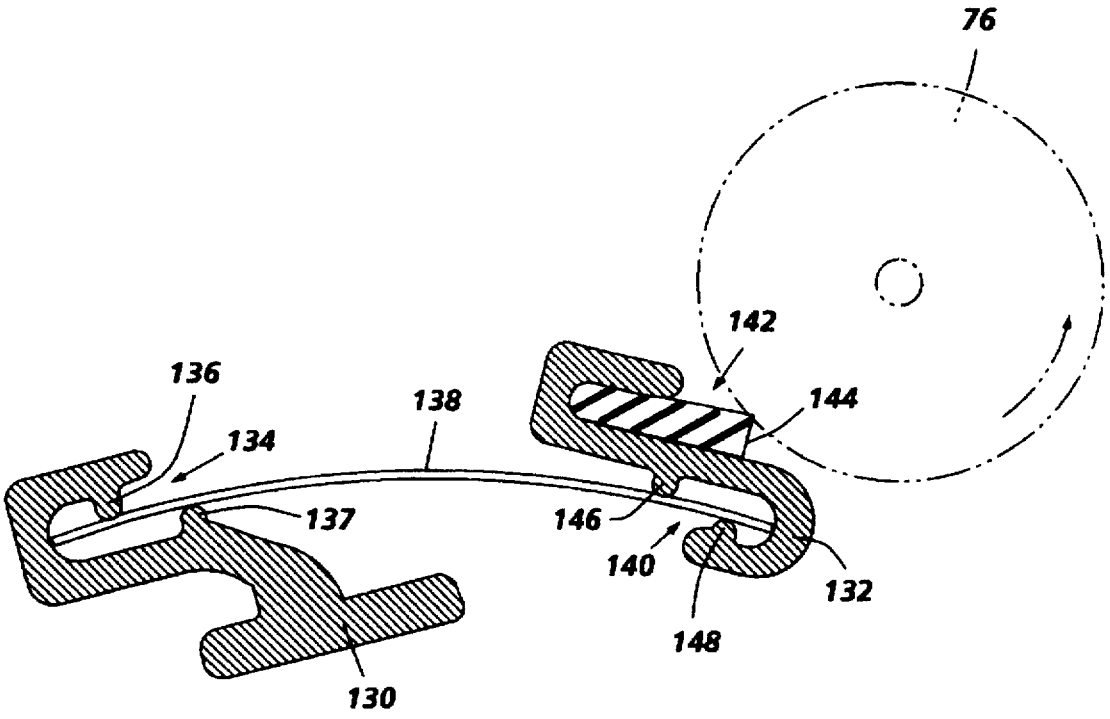
FIG. 3 is a schematic illustration of an oil metering blade construction according to another embodiment of the invention.
Figure 6:
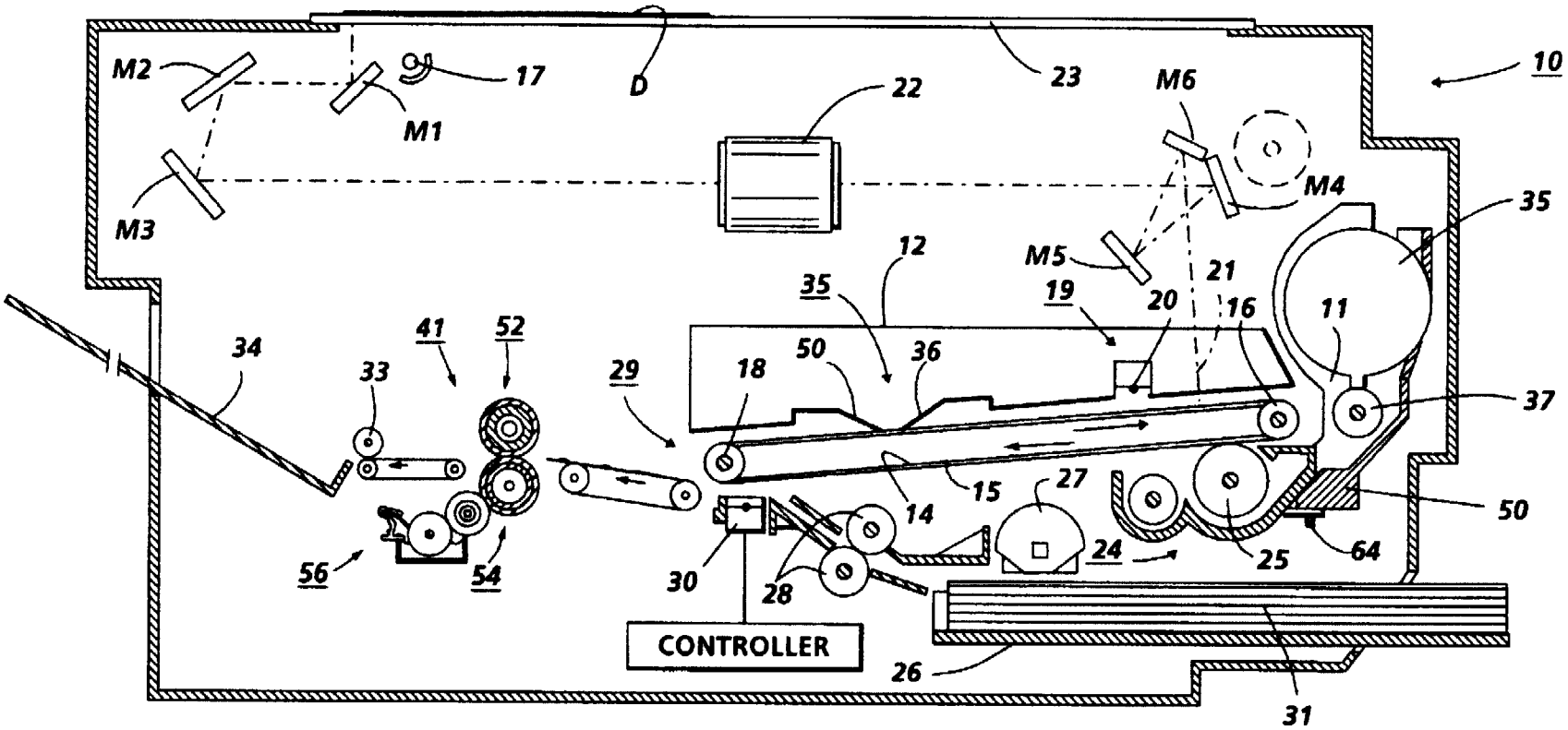
FIG. 6 is a schematic illustration of a copying machine incorporating the invention.

Referring now to FIG. 6, there is shown by way of example, an automatic electrostatographic reproducing machine 10 which includes a removable processing cartridge 12. The reproducing machine depicted in FIG. 3 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 6 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors M1, M2, M3 mounted to a scanning carriage (not shown) to scan an original document D on an imaging platen 23. Lens 22 and mirrors M4, M5, M6 transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fixing station 41 comprising heated fuser roll 52 and pressure roll 54 forming a nip therebetween wherein fuser 41 fixes the transferred powder image thereto.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scrapping contact with the outer periphery of the belt 14. The particles so removed are contained within cleaning housing (not shown) which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

Figure 1:
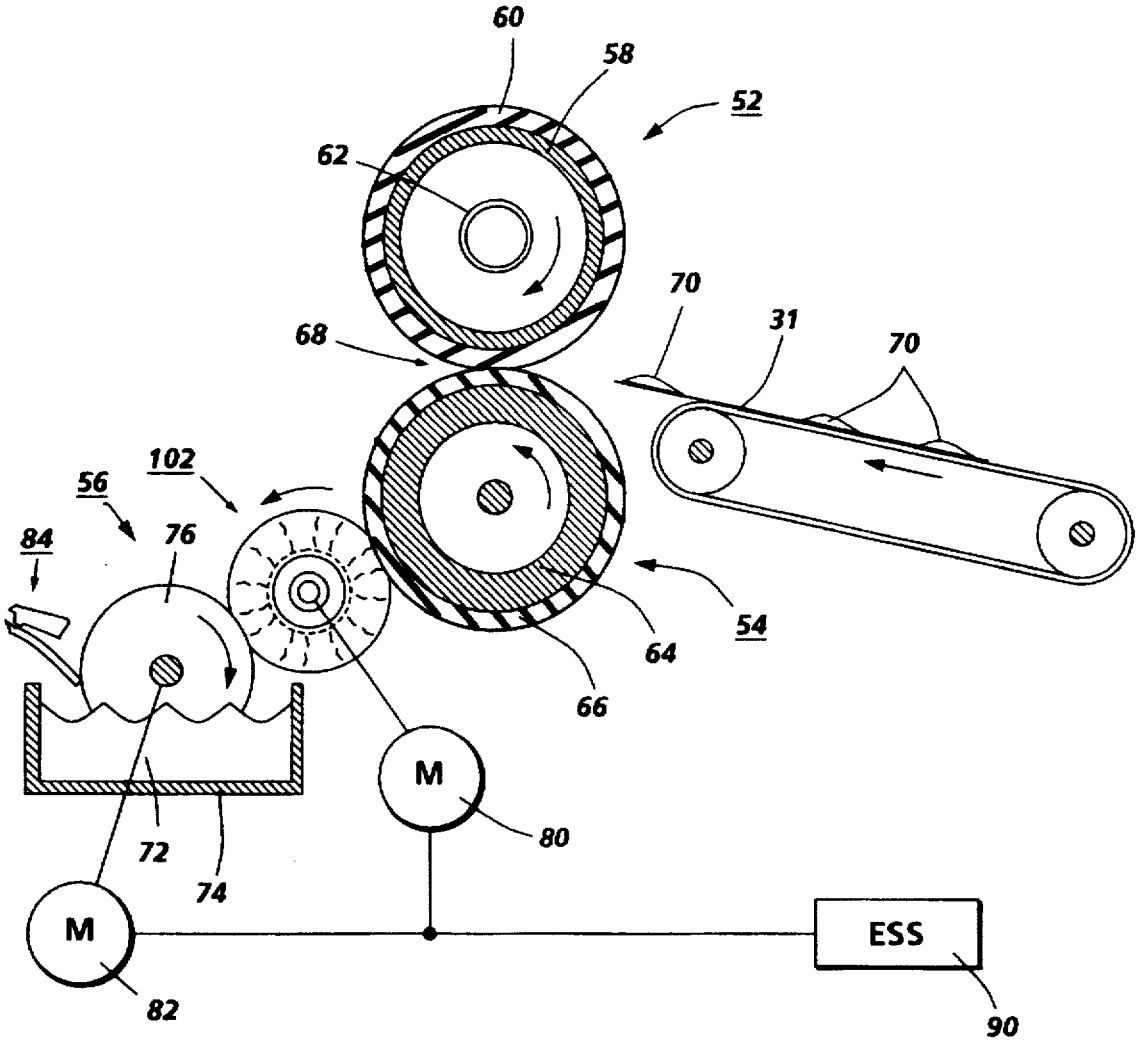
FIG. 1 is a schematic representation of a roll fuser and a release agent management (RAM) system representing one embodiment of the invention.

Attention is now directed to FIG. 1 wherein the heat and pressure fuser apparatus comprising the fuser roll 52 and pressure roll 54 are illustrated together with a release agent management (RAM) system 56. As shown in FIG. 1, the fuser apparatus comprises the heated fuser roll 52 which is composed of a core 58 having coated thereon a thin layer 60 of an elastomer or polymer. The core 58 may be made of various metals such as iron, aluminum, nickel, stainless steel, etc., and various synthetic resins. Aluminum is preferred as the material for the core 58, although this is not critical. The core 58 is hollow and a heating element 62 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The thin fusing elastomer layer may be made of any of the well known materials such as the RTV and HTV silicone elastomers as well as Viton (trademark of E.I. du Pont de Nemours & Co.) or low surface energy polymers like Teflon™.

The fuser roll 52 is shown in a pressure contact arrangement with the backup or pressure roll 54. The pressure roll 54 comprises a metal core 64 with a layer 66 of a deformable heat-resistant material. In this assembly, both the fuser roll 52 and the pressure roll 54 are mounted on bearings (not shown) which are biased so that the fuser roll 52 and pressure roll 54 are pressed against each other under sufficient pressure to form a nip 68. It is in this nip that the fusing or fixing action takes place. The layer 66 may be made of any of the well known materials such as fluorinated ethylene propylene copolymer or silicone rubber.

The image receiving member or final support 31 having toner images 70 thereon is moved through the nip 68 with the toner images contacting the heated fuser roll 52. The toner material forming the image 70 is prevented from offsetting to the surface of the fuser roll 52 by the application of a release agent material such as silicone oil 72 contained in sump 74 (FIG. 1).

The sump 74 and silicone oil 72 form part of the RAM system 56. The RAM system 56, according to one embodiment of the invention, further comprises a metering roll 76 and a donor brush 102. The metering roll is supported partially immersed in the silicone oil 72 and contacts the donor brush for conveying silicone oil from the sump to the bristles of the donor brush 102. The donor brush is rotatably supported in contact with the metering roll and also in contact with the pressure roll 54. While the donor brush is illustrated as contacting the pressure roll, it will be appreciated that, alternately, it may contact the fuser roll 52. Also, the positions of the fuser and pressure rolls may be reversed for use in other copiers or printers. Likewise, while a donor brush is shown, it could be a tractively driven metering roll comprised of an elastomer over a core and loaded against the metering roll 76 on pressure roll 54. Metering rolls are well known in the art. A metering blade structure 84 supported in contact with the metering roll 76 serves to meter silicone oil to the required thickness on the metering roll.

The speed of the donor member 102 is controlled by a motor 80 while the speed of the metering roll is controlled by a motor 82 which is, in turn, controlled by the Electronic Subsystem (ESS) 90. The ESS comprises the necessary electronics and logic circuitry, well know in the art, to process control signals generated by a sensor, not shown. The speed of the metering roll causes the metering roll to deliver somewhere between 1 to 6 μl of silicone oil to the donor brush in accordance with an algorithm forming a part of the ESS.

Figure 2:
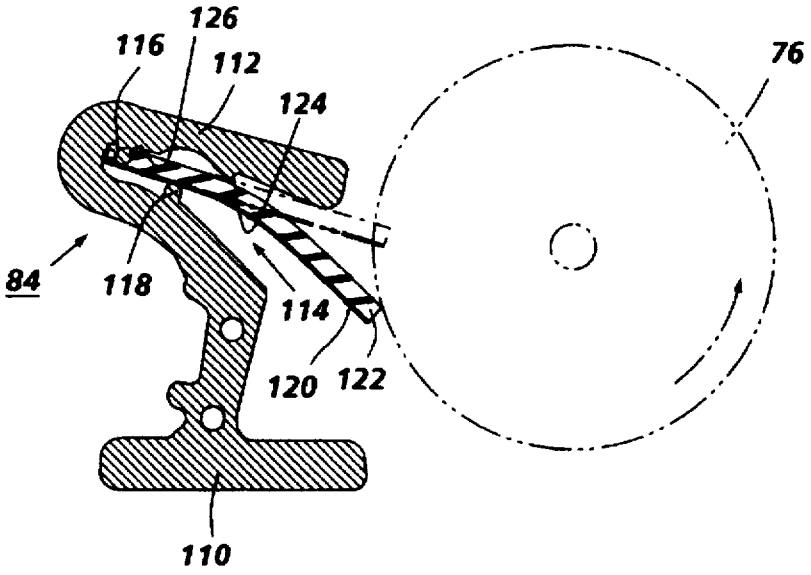
FIG. 2 is a schematic illustration of an oil metering blade construction according to one embodiment of the invention.

As disclosed in FIG. 2, the metering blade structure 84 comprises a blade holder 110. The blade holder may be fabricated from a suitable plastic or metal by well know extrusion methods. The blade holder comprises an upper portion 112 delineating a recessed area 114. A pair of nubs 116 and 118 serve to support a steel spring or shim member 120. The nubs are arranged such that when the spring is inserted therebetween it is held in place by cooperative forces applied by the nubs. A rubber blade 122 fabricated, by way of example, from silicone or Viton™ rubber is supported by the steel spring or shim member 120. A pair of protrusions 124 and 126 are provided for pinching the rubber blade as indicated in FIG. 2. The spring and rubber blade are shown in a deflected position indicated in solid line while the dotted line illustration of these two members represents an undeflected orientation upon installation of the blade structure prior to installation of the metering roll 76.

A modified embodiment of the invention as depicted in FIG. 3 comprises first and second holder members 130 and 132. The holder 130 is includes a recess 134 having a pair of pimples 136 and 137 disposed therein for captivating one end of a spring or shim member 138. The pimples act in the same way as the nubs 116 and 118 to captivate the spring 137. The other holder 132 is provided with a pair of recesses 140 and 142, the former of which is adapted to receive the other or opposite end of the spring or shim 138 and the latter of which receives a rubber blade 144. A pair of protrusions 146 and 148 in the recess 140 serves to captivate the aforementioned opposite end of the spring or shim 138. As will be appreciated from a consideration of the embodiment of FIG. 3 as well as the one depicted in FIG. 2, the functions of blade loading and metering are performed by the spring and blade as separate functions and not by a single component as is the case in some prior art RAM metering arrangements.

Figure 4:
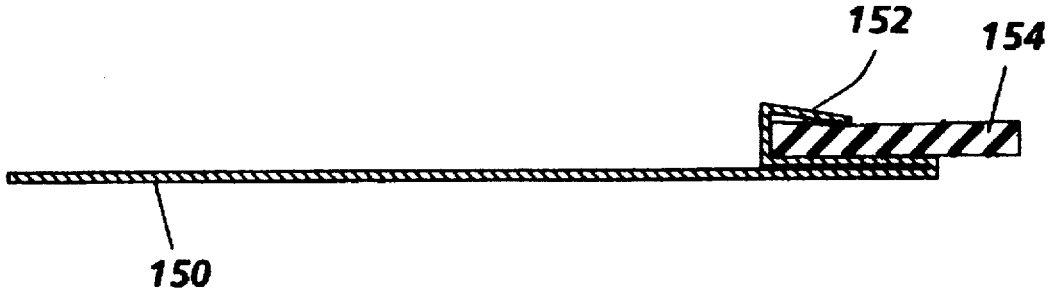
FIG. 4 is a schematic illustration of an oil metering blade construction according to yet another embodiment of the invention.

Another embodiment of the invention as disclosed in FIG. 4, comprises a steel spring member 150 which is formed such as to provide an integral recess 152 for receiving a rubber blade member 154. The recess 152 forms a clip for receiving the blade and securely holding it in place by friction. This structure could then be mounted in a holder like 110, 130 or 164.

Figure 5:
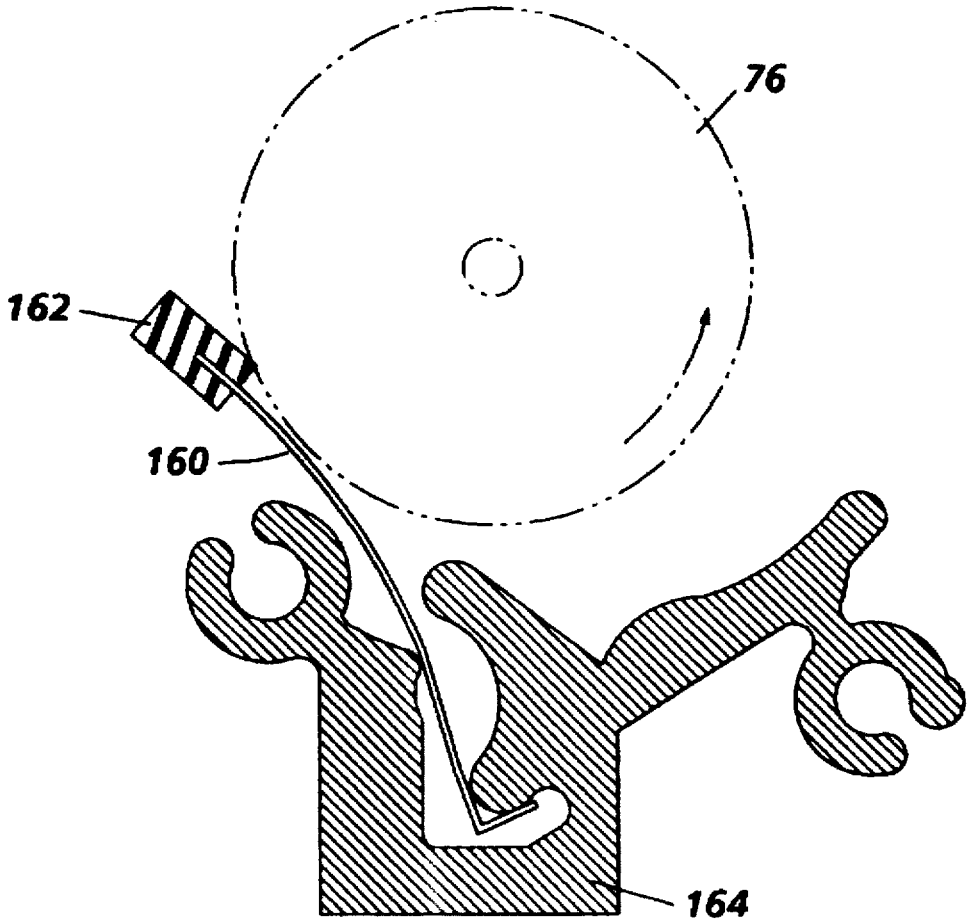
FIG. 5 is a schematic illustration of an oil metering blade construction according to still another embodiment of the invention.

The embodiment of the invention disclosed in FIG. 5 comprises a spring member 160 and a rubber blade member 162 secured to one end of the spring. The other end of the spring is secured in a holder structure 164. The assembled oil metering structure is mounted such that the holder 164 is positioned below the point of contact of the blade member 162 with the surface of the metering roll 76. This orientation is beneficial in re-oiling an oil supply wick, who's upper end is supported by holder 164 and the lower end in the oil pool 72. By mounting above or below a point of contact is meant upstream or downstream of of the metering site, relative to the direction of metering roll rotation. The blade structure 160, 162 shown in FIG. 5 could mounted in any of the other holders 110 or 130.

While there has been illustrated and described what is at present considered to be several preferred embodiments of the present invention, it will be appreciated that numerous changes and modifications are likely to occur to those skilled in the art, and it is intended in the appended claims to cover all those changes and modifications which fall within the true spirit and scope of the present invention.

What is claimed is:

1. Apparatus for applying offset preventing liquid to one member of a contact fuser for fixing powder images to a substrate, said apparatus comprising:

a supply of release agent material;

a release agent metering member supported for contact with said supply of release agent material;

means for effecting movement of said metering member in an endless path;

a donor member supported in contact with said metering member and a fuser member of said contact fuser for conveying release agent material from said metering member to said fuser member a deflection loaded metering blade structure contacting said release agent metering member;

a blade holder;

a spring member, said spring member and said blade structure being supported by said blade holder such that said spring member contacts said blade structure whereby loading and metering functions are performed one by said spring member and one by said blade structure.

2. Apparatus according to claim 1 wherein said blade holder comprises at least one recess for receiving said blade structure and further including means for captivating one end of said spring member.

3. Apparatus according to claim 2 wherein said means for captivating one end of said spring member comprises a pair oppositely disposed protrusions between which said one end is inserted.

4. Apparatus according to claim 2 wherein another end of said spring member is formed into a clip shape for receiving said blade structure.

5. Apparatus according to claim 1 wherein said blade holder comprises a pair of recesses including means disposed in one of said recesses for securing one end of said spring member and another of said recesses being smaller than said blade structure.

6. A metering blade structure for use in a release agent management system, said metering blade structure comprising:

a blade holder;

a spring member; and a blade member, said spring member and said blade member being supported by said blade holder such that said spring member contacts said blade member whereby loading and metering functions are performed one by the spring member and one by the blade member.

7. A metering blade structure according to claim 6 wherein said blade holder comprises at least one recess for receiving said blade member and further including means for captivating one end of said spring member.

8. A metering blade structure according to claim 7 wherein said means for captivating one end of said spring member comprises a pair oppositely disposed protrusions between which said one end is inserted.

9. A metering blade structure according to claim 7 wherein another end of said spring member is formed into a clip shape for receiving said blade member.

10. A metering structure according to claim 6 wherein said blade holder comprises a pair of recesses including means disposed in one of said recesses for securing one end of said spring member and another of said recesses being smaller than said blade member.

11. Apparatus for applying offset preventing liquid to one member of a contact fuser for fixing powder images to a substrate, said apparatus comprising:

a supply of release agent material;

a release agent metering member supported for contact with said supply of release agent material;

means for effecting movement of said metering member in an endless path;

a donor member supported in contact with said metering member and a fuser member of said contact fuser for conveying release agent material from the former to the latter;

a deflection loaded metering blade structure contacting said release agent metering member;

at least one blade structure holder having at least one recess including means for receiving and captivating one end of a spring member; and a second blade structure holder having a pair of recesses and means disposed in one of said recesses for securing an opposite end of said spring member and another of said recesses being smaller than a blade received therein.

12. Apparatus for applying offset preventing liquid to one member of a contact fuser for fixing powder images to a substrate, said apparatus comprising:

a supply of release agent material;

a release agent metering member supported for contact with said supply of release agent material;

means for effecting movement of said metering member in an endless path;

a donor member supported in contact with said metering member and a fuser member of said contact fuser for conveying release agent material from the former to the latter;

a deflection loaded metering blade structure contacting said release agent metering member; and at least one blade structure holder having at least one recess including means for receiving and captivating one end of a spring member, said means for captivating one end of said spring member comprising a pair oppositely disposed protrusions between which said one end is inserted.

* * * * *